US012005943B2

(12) United States Patent
Bjurström

(10) Patent No.: US 12,005,943 B2
(45) Date of Patent: Jun. 11, 2024

(54) SYSTEM AND APPARATUS FOR DETERMINING THE POSITION OF RAILBOUND VEHICLES ON A RAILWAY SYSTEM

(71) Applicant: ICOMERA AB, Gothenburg (SE)

(72) Inventor: Joel Bjurström, Gothenburg (SE)

(73) Assignee: Icomera AB, Gothenburg (SE)

( * ) Notice: Subject to any disclaimer, the term of this patent is extended or adjusted under 35 U.S.C. 154(b) by 731 days.

(21) Appl. No.: 17/052,776

(22) PCT Filed: May 23, 2019

(86) PCT No.: PCT/SE2019/050474
§ 371 (c)(1),
(2) Date: Nov. 3, 2020

(87) PCT Pub. No.: WO2019/226114
PCT Pub. Date: Nov. 28, 2019

(65) Prior Publication Data

US 2021/0070335 A1 Mar. 11, 2021

(30) Foreign Application Priority Data

May 24, 2018 (SE) ..... 1850624-6

(51) Int. Cl.
*B61L 27/30* (2022.01)
*B61L 25/02* (2006.01)
(Continued)

(52) U.S. Cl.
CPC ..... *B61L 27/30* (2022.01); *B61L 25/025* (2013.01); *B61L 27/70* (2022.01); *B61L 2027/204* (2022.01)

(58) Field of Classification Search
CPC ..... B61L 27/30; B61L 27/70; B61L 25/025; B61L 25/021; B61L 2027/204; B61L 2205/02; B61L 2205/04; B61L 15/0027
See application file for complete search history.

(56) References Cited

U.S. PATENT DOCUMENTS

2014/0209753 A1 7/2014 Takahashi et al.
2014/0209758 A1 7/2014 Kurita
(Continued)

FOREIGN PATENT DOCUMENTS

EP 1147966 A1 10/2001
JP 2010269620 A * 12/2010
(Continued)

OTHER PUBLICATIONS

Farooq et al.; Radio Communication for Communications-Based Train Control (CBTC): A Tutorial and Survey; IEEE Communications Surveys & Tutorials, vol. 19, No. 3, Third Quarter 2017; pp. 1377-1402 (Year: 2017).*
(Continued)

*Primary Examiner* — Michael J Zanelli
(74) *Attorney, Agent, or Firm* — AVEK IP, LLC

(57) ABSTRACT

A method and system for determining a position of a rail-bound vehicle on a railway is disclosed. The apparatus comprises: a transmitter and receiver for wireless communication with at least one base station arranged at a predetermined position in the vicinity of the railway; a measurement device to determine a distance to the at least one base station based on measurements of the radio signals of the wireless communication in the phase domain; and a controller arranged to determine a present position of the vehicle on the railway based on the distance. A control system/method for controlling rail-bound vehicles in a railway system, and/or an internal or external system related to
(Continued)

such rail-bound vehicles, using such position determination is also disclosed.

13 Claims, 5 Drawing Sheets

(51) Int. Cl.
*B61L 27/20* (2022.01)
*B61L 27/70* (2022.01)

(56) References Cited

U.S. PATENT DOCUMENTS

| | | | |
|---|---|---|---|
| 2016/0068173 | A1 | 3/2016 | Fuchs et al. |
| 2016/0325766 | A1 | 11/2016 | Tsujita et al. |
| 2017/0223592 | A1 | 8/2017 | Karlsson et al. |

FOREIGN PATENT DOCUMENTS

| | | | | |
|---|---|---|---|---|
| KR | 20040037730 | A | * | 5/2004 |
| WO | 2000/052851 | A1 | | 9/2000 |
| WO | 2004040327 | A1 | | 5/2004 |

OTHER PUBLICATIONS

Extended European Search Report, dated Feb. 7, 2022, 9 pages, issued in European Application No. 19807777.8.
International Search Report in related application PCT/SE2019/050474, dated Aug. 7, 2019.

* cited by examiner

SYSTEM AND APPARATUS FOR DETERMINING THE POSITION OF RAILBOUND VEHICLES ON A RAILWAY SYSTEM

CROSS-REFERENCE TO RELATED APPLICATIONS

This application is the U.S. national phase of, and claims priority to, International Application No. PCT/SE2019/050474, filed May 23, 2019, which designated the U.S. and which claims priority to Swedish Patent Application No. 1850624-6, filed May 24, 2018.

TECHNICAL FIELD OF THE INVENTION

The invention relates to a method and system for determining the position of rail-bound vehicles, such as trains, on any type of railway system, and is of particular advantage for railway systems arranged underground, such as for metros, subways and the like, where alternate means such as GNSS are not available.

BACKGROUND

There has long existed a need for knowing and determining the position of rail-bound vehicles on a railway system. The need for technological means to determine and relay the location of rolling stock in a rail network is primarily used for two categories of purposes. Firstly, for remote awareness and overview: allowing a person (or a technological system) to be aware of the position of trains in the rail network, without being physically present to observe the train, and being able to simultaneously receive information about the position of multiple trains throughout the rail network. Secondly, for value-adding automated processing: allowing a technological system (either onboard the train, or remote) to automatically generate more complex information based on the position information, for the purpose of relieving persons of strenuous manual and mental processing. Some examples may be: the automatic presentation of trains' positions on a map; automatic announcements as the train approaches a station, or automatic calculation of the estimated time of arrival at a station.

At present, positioning of trains for safety-critical purposes is performed using track circuits, axle counters or balises (dedicated transponders). All three have in common that special devices must be installed at close intervals throughout the rail network, devices which serve no purpose apart from train positioning, and thus require an expensive investment and bear high maintenance costs. In addition, the positioning resolution of such systems is very low, and directly tied to the number of detection devices installed along the track. Thus, increasing positioning resolution is very costly.

In later years, less critical systems employ satellite-based GNSS positioning of the trains, such as using GPS positioning. The positional accuracy of such systems is much higher than the aforementioned positioning methods, and no infrastructure costs directly related to the rail network are imposed, since the cost of the satellites does not need to be borne by the user of the satellite-based train positioning system. However, the reliability and availability of satellite-based positioning is not considered good enough for critical systems: the radio signals from the satellites are very weak, and thus are easily jammed or disturbed by intentional or non-intentional interference. Further, such signals do not penetrate into tunnels, making satellite-based positioning unavailable in tunnels and subway networks, for example.

There is therefore a need for an improved method and system for determining the position of rail-bound vehicles on a railway system.

SUMMARY OF THE INVENTION

It is therefore an object of the invention to provide a control system/apparatus and a control method for rail-bound vehicles, and in particular a train, which alleviates all or at least some of the above-discussed drawbacks of the presently known systems.

This and other objects is achieved by means of a system, apparatus and method as defined in the appended claims.

According to a first aspect of the invention there is provided a control system for controlling rail-bound vehicles in a railway system, and/or an internal or external system related to such rail-bound vehicles, the control system comprising a controller arranged to determine present positions of rail-bound vehicles on at least one railway of the railway system, and to issue control signals to control the operation of said vehicles and/or system related to the vehicles based on said determined present positions, wherein the present positions of said vehicles are determined based on radio signal measurements in the time domain and/or phase domain of wireless communication occurring between each vehicle and base stations arranged at predetermined positions in the vicinity of said railways.

According to another aspect of the invention, there is provided a method for controlling rail-bound vehicles in a railway system, and/or an internal or external system related to such rail-bound vehicles, the method comprising: measuring radio signal in the time domain and/or phase domain of wireless communication occurring between each vehicle and base stations arranged at predetermined positions in the vicinity of said railways; determining present positions of the rail-bound vehicles on at least one railway of the railway system based on said measurements; and issuing control signals to control the operation of said vehicles and/or said system related to the vehicles based on said determined present positions.

According to yet another aspect of the invention, there is provided an apparatus for determining a position of a rail-bound vehicle on a railway, the apparatus comprising: a transmitter and receiver for wireless communication with at least one base station arranged at a predetermined position in the vicinity of the railway; a measurement device to determine a distance to said at least one base station based on measurements of the radio signals of said wireless communication in the time domain and/or phase domain; and a controller arranged to determine a present position of said vehicle on said railway based on said distance.

According to another aspect of the invention, there is provided a method for determining a position of a rail-bound vehicle on a railway, the method comprising: providing wireless communication with at least one base station arranged at a predetermined position in the vicinity of the railway; measuring a distance to said at least one base station based on measurements of the radio signals of said wireless communication in the time domain and/or phase domain; and determining a present position of said vehicle on said railway based on said distance.

The invention is based on the realization that positioning based on radio signal measurements of radio signals transferred between the rail-bound vehicle and base stations arranged in the vicinity of the railway(s) have many unexpected and important advantages. The invention is also based on the realization that rail-bound vehicles only travel in one dimension, along a single line which is well-defined by the railway track, thereby making it possible to determine an exact location in two dimensions based solely on a determined distance to a fixed point. It is also based on the fact that the base stations with which the vehicles communicate are fixed in location. The exact location of the base stations can be received from the operators, and could also easily be identified by initialization measurements. Thus, the exact location of the base stations can easily be determined and registered in the system during initialization.

The new positioning scheme can easily be implemented in essentially any rail-bound vehicle without any significant installation or maintenance costs. The infrastructure for railways already provide essentially all necessary hardware necessary to implement this new type of position determination, since most, if not all, rail-bound vehicles are already provided with communication systems for wireless communication via one or several external wireless communication network(s). The invention provides positioning capabilities using already existing wayside and vehicle borne equipment that also, already, serves the purpose of providing a communications link, thus reducing or eliminating the investment and maintenance costs attributable to the installation and maintenance of a positioning system.

Further, the new way of position determination is extremely accurate, safe and reliable. In particular, the new position determination is at least as safe and reliable as currently used systems, using e.g. balises and axle counters, and much more accurate.

It is also more accurate, and with greatly improved safety and reliability, compared to GPS based systems.

The new positioning system/method works well over the entire railway network, regardless of tunnels and other environmental conditions.

Since the positioning is based on radio signals sent between the vehicle and relatively closely located base stations, and also with use of relatively high frequencies, the signals strength and signal power becomes high, and the signals are difficult to disturb. This is particularly the case when more than one frequency is used, e.g. when broadband communication is used, which is generally the case in conventional wireless communication. Compared to GPS signals, the signal power/strength of wireless communication as in the invention is at least a million times higher, and probably at least a billion times higher. Also, the new positioning is very insensitive for atmospheric variations and the like.

The resistance to disturbances and jamming is even further enhanced due to the fact that most presently used wireless communication standards use focused signal beams within the communications links. Further, underground/tunnel availability is made possible by the fact that the wireless communications link's base stations are already normally installed within the underground network or tunnels, such that wireless coverage is already provided even in these cases. This makes the new invention particularly suited for underground systems, such as subway and metro systems.

The invention may even use a dedicated wireless communication system provided for safe and reliable communication between the train and an external control center, such as the dedicated wireless communication system GSM-R used to this end in Europe. Thus, the availability and reliability of the new positioning method/apparatus is as high as the availability and reliability of the underlying communications link. By using communications links designed for safety critical purposes, such as GSM-R, the inventive positioning method may without excessive effort achieve the same level of availability and reliability. However, other types of wireless communication, such as by WLAN communication, such as in accordance with the IEEE 802.11 standard, or communication via one or several of presently available 3G, 4G and 5G standards may also be used with the same safety and reliability.

With the new positioning method/system, positions can be determined very accurately, such as with a precision and accuracy down to a few millimeters. This is much more accurate and precise than GPS measurements, and far better than the accuracy and precision provided by currently used systems using balises, axle counters and the like. In such systems, the precision and accuracy are at best 50 meters or the like, but in rural areas, between stations, the balises are often arranged kilometers apart.

In accordance with embodiments of the invention, the radio signal measurements comprise measuring of a propagation time for radio signals transferred between the vehicles and the base stations. In particular, the propagation time may be measured by measuring the round-trip time for a data packet to be sent from a first party to the other party, and a response to be sent back from the second party to the first party, and subtracting the round-trip time with a processing time of the second party before sending the response.

Having determined the propagation time for signals travelling from the vehicle to the base station or from the base station to the vehicle, it is simple to determine the exact distance, since the radio signals travels with the speed of light. Thus, the distance may be calculated as the propagation time multiplied with the speed of light. By knowing the distance to the base station, and by knowing the fixed position of the base station, as well as the fixed path of the railway track, it is possible to determine with great exactness the position of the vehicle travelling on the railway track.

Determination of the propagation time can be made in many different ways. In one embodiment, the round-trip time of data packets may be measured. An initiating party (either the vehicle-based equipment or a wayside base station) records the time-of-departure of a data packet sent over the air. A responding party receives the data packet, recording the time-of-reception. The responding party then transmits a response data packet and records the time-of-departure. The responding party informs the initiating party about the time-of-reception and time-of-departure recorded by the responding party (or the difference between them). The initiating party records the time-of-reception of the response packet transmitted by the responding party. The initiating party may then calculate the propagation delay by subtracting the responding party's processing time, i.e. the difference between time-of-reception and time-of-departure as recorded by the responding party, from the total round-trip time, i.e. the difference between the time-of-departure and time-of-reception as recorded by the initiating party, and divides the result by two. The distance between the train and the base station is calculated by multiplying the propagation delay with the speed of light. The aforementioned data packets may be transmitted for the sole purpose of positioning, or may be normal payload-carrying data packets within the communications link, upon which the aforementioned measurements are performed.

In accordance with another embodiment of the invention, the radio signal measurements comprise measuring of a phase difference of radio signals of different frequencies transferred between the vehicles and the base stations. Thus, the distance is here determined based on the difference in phase between signals received at the various possible frequencies of operation of a wireless broadband communications link. This embodiment exploits the fact that the communications link is able to operate at a range of different carrier frequencies, and utilizes the fact that the signal phase at the receiving station with respect to the phase at the transmitting station is dependent on: a) the carrier frequency, and b) the distance between the transmitting and the receiving station. Thus, the phase set for each position is unique within a range of plausible distances from the base stations. By determining the phase of the received signal with respect to the transmitted signal at a plurality of carrier frequencies, the distance between the transmitting and receiving stations can be determined as it will represent the only mathematically possible solution to a system of equations describing the phases of signal received with respect to signals transmitted of each carrier frequency as functions of the distance between the transmitting and receiving stations.

However, it also possible to make radio signal measurement in both the time and phase domain. This increases the accuracy and robustness of the method/system even further.

Still further, it is also possible to determine the distance between the vehicle and the base station based on signal strength/power, since the signal strength/power will diminish as a function of the distance. However, since the signal strength/power will also be dependent on e.g. geographical features, man-made structures, air humidity and other radio traffic, it is less reliable, and is therefore a somewhat less preferred alternative. Nonetheless, this method may still be used in combination with measurements in the time and/or phase domain, to increase the overall accuracy and robustness of the system.

When the vehicle passes through a junction, it is possible to determine which of the two or more tracks that has been chosen based on the radio communication with the trackside base stations, e.g. by measurements in the time and/or phase domain. Thus, at least some distance after the junction, the control system will be able to determine which track the vehicle travels on. However, in some cases, where the two or more tracks are relatively close to each other, or where greater precision in the position determination is needed in the vicinity of the junction, additional measures may be taken to determine which track that is or has been selected. To this end, the control system may further include a sensor arranged to determine which track that is selected when the vehicle passes through a junction. The sensor may e.g. be a signal sensor/receiver, receiving signals from transponders, balises or the like, arranged on one or both/several of the tracks branching out at the junction. However, other types of sensors may also be used. For example, the sensor may be a GNSS sensor, receiving GNSS signals, such as GPS signals, and thereby enabling determination of which track that has been selected. The sensor may also be an acceleration sensor, a gyro sensor or the like, being capable of determining in which direction and how fast the vehicle turns, a camera being able to determine the track based on image analysis, etc.

Since the positions of the vehicles can now be determined with very great precision, and in real-time, the controller may further be arranged to determine at least one of travelling speed and travelling direction for the rail-bound vehicles based on the radio signal measurements. This can e.g. be done by storing position data for the vehicle for one or several previously made determinations, and to make calculations based on the differences. Similarly, the controller can hereby also determine acceleration and deceleration for the vehicles.

The invention is particularly suited to be integrated in a control system automatically or semi-automatically controlling the rail-bound vehicles, for controlling e.g. start, stop and speed of rail-bound vehicles travelling on a railway network, based on the issued control signals. For example, the control system of the present invention may be, or form a part of, a CBTC (Communication Based Train Control) system. Thus, the invention may be used in an improved system to determine and relay the location of rolling stock in a rail network. Such CBTC systems, and other, similar systems in which the invention may be used, can be both for manually operated vehicles or for automatically or semi-automatically operated vehicles, such as in driverless trains and the like. In such a CBTC system, equipment mounted on the rail-bound vehicles (on-board equipment) or in the wayside infrastructure (track-side equipment) may calculate the position of the vehicle and transmit the position data to control equipment located on the ground (track-side equipment) by radio. The track-side equipment or the on-board equipment may calculate a limit point for safe traveling of the vehicle and transmit the limit point to the vehicle. Using the limit point as a stop target, the respective vehicle controls may control the vehicles themselves to be capable of safely stopping before the stop target.

Due to the greatly improved positioning data obtainable by the present invention, it enables a greatly improved efficiency in the use of the available railway systems. Since the exact location of trains and other vehicles can now be determined with more accuracy, in real-time and with finer resolution, and also possibly the exact speed, travel direction, etc., trains/vehicles can be allowed to be closer to each other, thereby enabling a denser traffic on the railways, and a better, more efficient use of the available infrastructure. This more efficient use can also be achieved with the same or improved safety compared to previously known systems, and with similar or improved robustness and reliability.

The precisely determined position, and the control signals issued based on this, may be used to provide remote awareness and overview of the vehicles. This may e.g. allow a person or a technological system to be aware of the position of trains and other types of rail-guided vehicles in the rail network, without being physically present to observe the train, and being able to simultaneously receive information about the position of multiple trains/vehicles throughout the rail network.

However, the precisely determined position, and the control signals issued based on this, may also, additionally or alternatively, be used for other purposes. For example, the control signals may be used in internal or external systems related to such rail-bound vehicles. For example, it may be used for value-adding automated processing, such as to allow a technological system, either onboard the train, or remote, to automatically generate more complex information based on the position information, for the purpose of relieving persons of strenuous manual and mental processing. Some examples may be to track and automatically present the train/vehicle positions on a map, to enable automatic announcements as the train/vehicle approaches a station, or automatic calculation of the estimated time of arrival at a station. It may also be used in systems analyzing the driver behavior, etc., e.g. for use in energy-efficient driving systems and the like. It may also be used for controlling internal subsystems within the vehicles, such as controlling the lighting inside or outside the vehicle, controlling information displays and loudspeaker systems to announce information to the passengers as text, video or sound. It may also be used to provide information to scheduling and controlling the activities and operation of clearance personnel, cleaning personnel, etc.

The wireless communication can be provided over a Wireless Local Area Network (WLAN) and/or via cellular network standard(s), such as in accordance with 3G, 4G or 5G standards. In particular, it may be preferred that the wireless communication is made by at least one of: WLAN, in particular in accordance with the IEEE 802.11 standard, and GSM-R.

The base stations are preferably trackside base stations arranged distributed along the extension of the railway(s). In particular, the trackside base stations may be access points for communication in compliance with a WLAN standard, and preferably in compliance with the IEEE 802.11 standard.

The controller as discussed above may be arranged on the vehicle and/or in an external, remote connection, e.g. at the base stations, or being connected to the base stations. When arranged on a vehicle, the controller may be integrated with, or connected to, a mobile router arranged within the railbound vehicle. By "router" or "mobile router" is here meant a networking router, which is a machine that forwards data packets between computer networks, on at least one data link in each direction. The router may be a mobile access router, and preferably a mobile access and applications router.

An internal LAN may be provided inside the public transport vehicle for providing wireless communication between the router and at least one client onboard. The at least one client onboard may accordingly be connected to said router via a LAN (local area network) provided by one or more wireless access points within the public transport vehicle. Preferably, at least one such wireless access point is provided in each carriage. All wireless access points may be connected to a single, central router, arranged in one of the carriages of a train. However, each carriage in the train may also be provided with a separate router connected to at least one wireless access point, where the wireless access point may be external to the router or an integrated function of the router.

The method of the invention can be implemented and realized solely or to a large extent in software, but may also, to some extent or even completely be realized in hardware.

In embodiments, the vehicle route/path is predetermined and the external wireless network comprising a plurality of trackside base stations, such as trackside access points, distributed along a vehicle path of travel, and located along the predetermined route. The coverage of each trackside base station is inter alia dependent on the height of the antenna of the cell, the height of the vehicle, the maximum, minimum or average distance between the vehicle and the antenna, and the frequency of communication. Preferably, the trackside base stations are operated at carrier frequencies of about 5 GHz or of about 60 GHz.

The communication between the trackside base stations and the mobile router is preferably made in compliance with a WLAN standard, and most preferably in compliance with the IEEE 802.11 standard (which may also be referred to as WiFi). However, it is also possible to use other wireless communication protocols.

Preferably, the controller comprises or is connected to a database comprising data at least about the identity of the base stations and the position of the base stations, and optionally also about the coverage area of the trackside base stations in relation to the vehicle path.

The base stations/access points may at least at some locations be arranged so that there is at least some overlap between the coverage areas for neighboring base stations. When a vehicle travels through this overlap area, a conventional handover may be performed from the previously passed base stations to the base stations ahead of the vehicle. Alternatively, or additionally, the overlapping coverage areas can be used to enable simultaneous communication with more than one base stations. Thus, the mobile router can be arranged to simultaneously communicate with the external mobile network through at least two base stations when more than one base station is accessible for the mobile router, thereby providing two concurrently useable data links. This enhances the communication performance significantly, and also alleviates the problems related to handovers.

Similarly, when the vehicle is within the coverage area of more than one base station, it is also possible to sequentially or simultaneously determine the position of the vehicle in relation to two or more base stations. This increases the accuracy and robustness of the system even further.

The router may, in addition to the trackside WLAN (or other protocol used for the communication with the trackside base stations), use any available data links, such as GSM, Satellite, DVB-T, HSPA, EDGE, 1×RTT, EVDO, LTE, Wi-Fi and WiMAX; and optionally combine them into one virtual network connection. In particular, it may be preferred to use data links provided through wireless wide-area network (WWAN) communication technologies.

Similar advantages and preferred features are feasible and obtainable by all of the above-discussed aspects of the invention.

These and other features and advantages of the invention will in the following be further clarified with reference to the embodiments described hereinafter.

BRIEF DESCRIPTION OF THE DRAWINGS

For exemplifying purposes, the invention will be described in closer detail in the following with reference to embodiments thereof illustrated in the attached drawings, wherein.

DETAILED DESCRIPTION OF PREFERRED EMBODIMENTS

In the following detailed description, preferred embodiments of the invention will be described. However, it is to be understood that features of the different embodiments are exchangeable between the embodiments and may be combined in different ways, unless anything else is specifically indicated. Even though in the following description, numerous specific details are set forth to provide a more thorough understanding of the invention, it will be apparent to one skilled in the art that the invention may be practiced without these specific details. In other instances, well known constructions or functions are not described in detail, so as not to obscure the invention. In the detailed embodiments described in the following are related to trains. However, it is to be acknowledged by the skilled reader that the method and system are correspondingly useable on other rail-bound vehicles. In particular, the invention is very well suited for use in underground railway systems.

Figure 1:
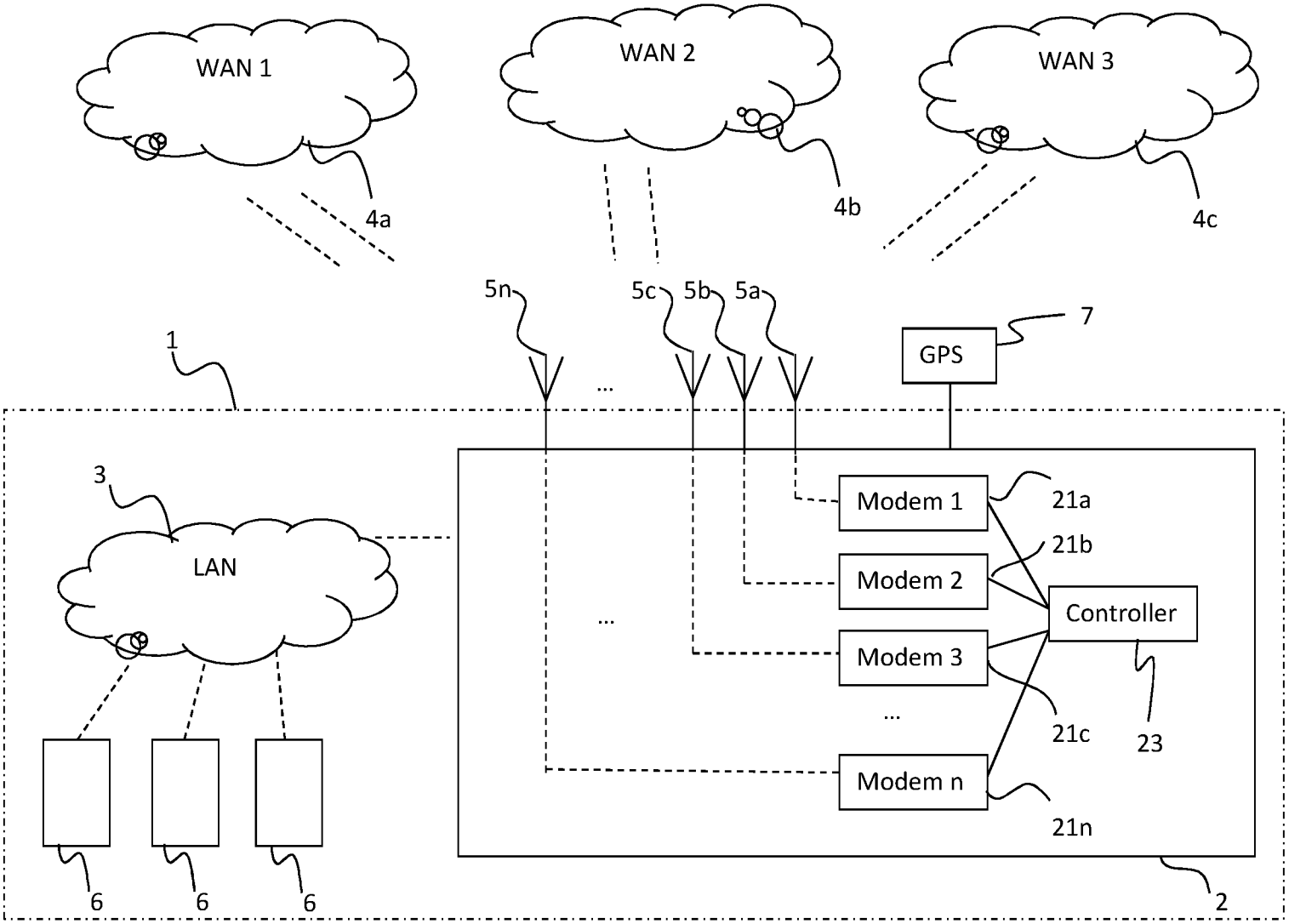
FIG. 1 is a schematic illustration of a train having a wireless communication system in accordance with an embodiment of the present invention.

In FIG. 1 a schematic illustration of a rail-bound vehicle 1, such as a train, having a communication system. In this embodiment, the communication system comprises a data communication router 2 for receiving and transmitting data between an internal local area network (LAN) 3, and one or several external wide area networks (WANs) 4*a*, 4*b*, 4*c*, and preferably including at least one external network having a plurality of trackside base stations/access points distributed along a vehicle path of travel, preferably for communication in compliance with a Wireless Local Area Network (WLAN) standard, such as an 802.11 standard.

Communication to and from the WANs is provided through one or several antennas 5*a-n* arranged on the train, the antennas may be arranged on the roof of the train, on window panes of the train, etc. Two or more data links are preferably available, either between the train and one of the WANs, and/or by using several WANs simultaneously.

The LAN is preferably a wireless network, using one or several internal antennas to communicate with terminal units 6 within the vehicle. It is also possible to use a wired network within the vehicle. The LAN may be set-up as wireless access point(s). The client(s) 6 may be computing devices such as laptops, mobiles telephones, PDAs, tablets and so on.

The data communication router further preferably comprises a plurality of modems 21*a-n*. Assignment of data streams to different WANs and/or to different data links on one WAN is controlled by a router controller 23. The router controller 23 is preferably realized as a software controlled processor. However, the router controller may alternatively be realized wholly or partly in hardware.

The system may also comprise a receiver for receiving GNSS (Global Navigation Satellite System) signals, such as a global positioning system (GPS) receiver 7 for receiving GPS signals, indicative of the current position of the vehicle. The GNSS/GPS signals may be used for providing positioning data for applications which are less critical, and where the requirements for exactness and security are low. It may also be used as a complement to the position determination based on radio signal measurement, discussed in more detail below, to improve the accuracy and robustness of this even further.

The data communication router may also be denominated MAR (Mobile Access Router) or MAAR (Mobile Access and Applications Router).

Figure 2:
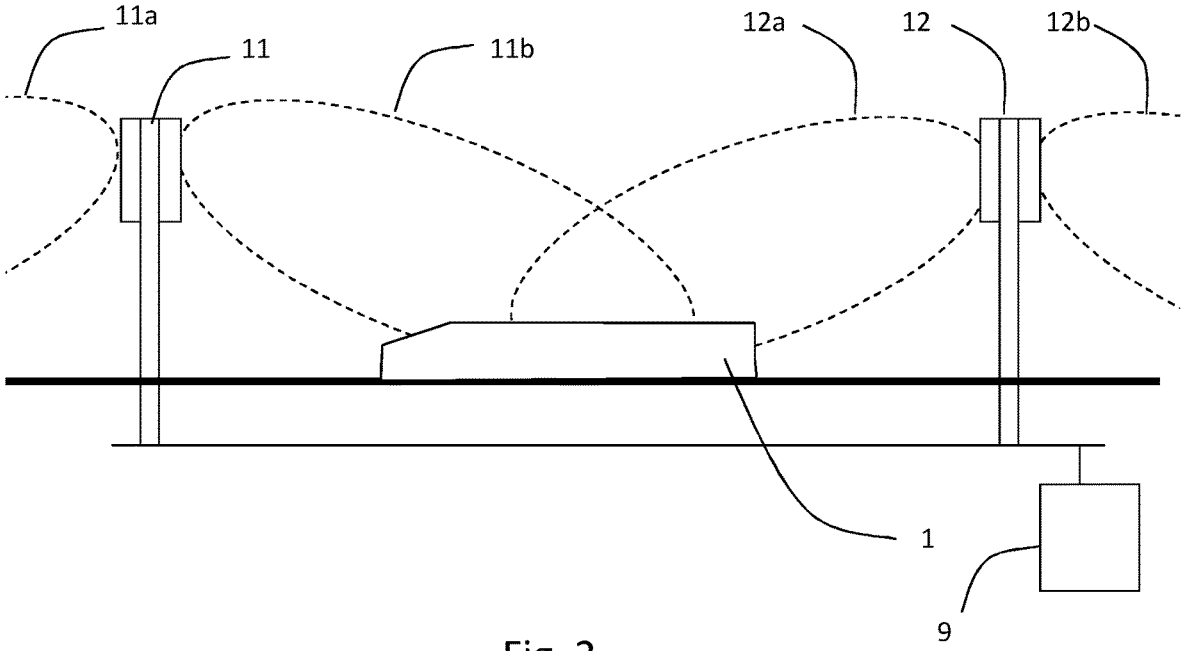
FIG. 2 is a schematic illustration of a train being associated with two trackside base stations of an external mobile network.

In FIG. 2, the external wide area network (WAN) including a plurality of trackside base stations, such as trackside access points, distributed along a vehicle path of travel, i.e. the rail, for communication in compliance with a Wireless Local Area Network (WLAN) standard, such as an 802.11 standard, is illustrated in more detail. The external mobile network comprises a plurality of trackside base stations 11, 12, arranged along the vehicle path. The antenna devices have coverage areas 11*a*, 11*b*, 12*a*, 12*b* extending in both directions along the vehicle path. The coverage areas on the two sides of the antenna devices may be related to the same base station/access point, or to different base stations/access points. Thus, coverage area 11*a* and 11*b* may be related to the same base station/access point, or be operated independently, as different base stations/access points, and the same applies to coverage areas 12*a* and 12*b*, etc.

The base stations/access points are connected to a controller 9, via a wired or wireless connection, such as via a fiber connection. The controller is preferably realized on a processor, and at least partly in software. However, the controller may also be realized on several processors, in a distributed fashion. The coverage areas may be overlapping, allowing the mobile router of the vehicle to access several access points simultaneously, and thereby distribute the communication between several data links.

The mobile router may also be connected to other external networks, and may consequently simultaneously distribute the communication also over these networks.

Figure 3:
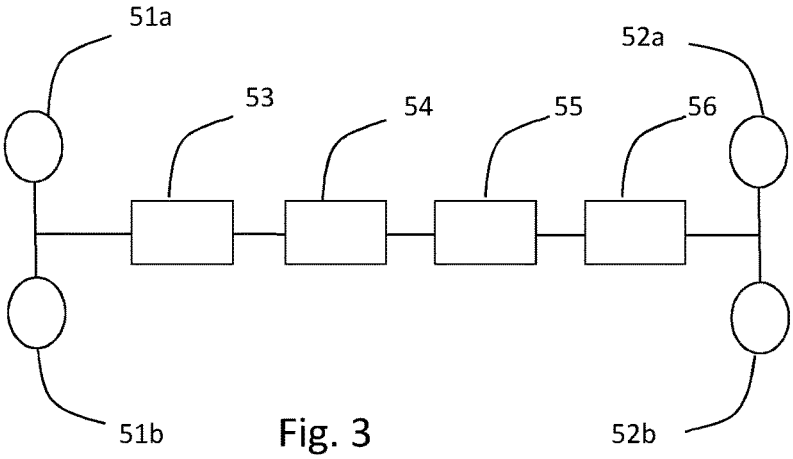
FIG. 3 is a schematic illustration of an antenna configuration to be used on trains in the systems of FIGS. 1 and 2.

Thus, the vehicle preferably comprises a plurality of antennas, for communicating with different links and different external networks. A schematic illustration of this is provided in FIG. 3. This antenna arrangement, for example arranged on the roof of the train, may comprise directional antennas 51*a* and 51*b* directed to access points in the backward direction of the train, directional antennas 52*a* and 52*b* directed to access points in the forward direction of the train, and additional antennas 53-56 arranged to communicate with base stations of other external networks, e.g. via GSM, Satellite, DVB-T, HSPA, EDGE, 1×RTT, EVDO, LTE, Wi-Fi (apart from the trackside WLAN) and WiMAX. However, antennas may also be arranged at the front and aft side of the train. Such positioning of the antennas is particularly useful for trains travelling in tunnels, since a more central placement of the antennas increases the line of sight.

In the above-discussed exemplary embodiment, the control system for controlling rail-bound vehicles in a railway system, and/or for controlling internal or external systems related to such vehicles, and in particular for determining position of the vehicle, to be discussed in more detail in the following, may be realized in a communication system as discussed above, which also enables communication for client devices in the vehicle with one or several external network(s). However, the control system may also be realized in a train communication system only enabling communication with the external network(s) for an operation system of the vehicle, for the driver of the vehicle, or the like. The control system may also be realized as a dedicated system, only for use in determining a position of the vehicle. Further, additionally or alternatively, the control system may be arranged externally from the vehicle, and may e.g. be connected to or arranged in one or several of the trackside base stations, or be arranged in or connected to the controller 9.

Figure 4:
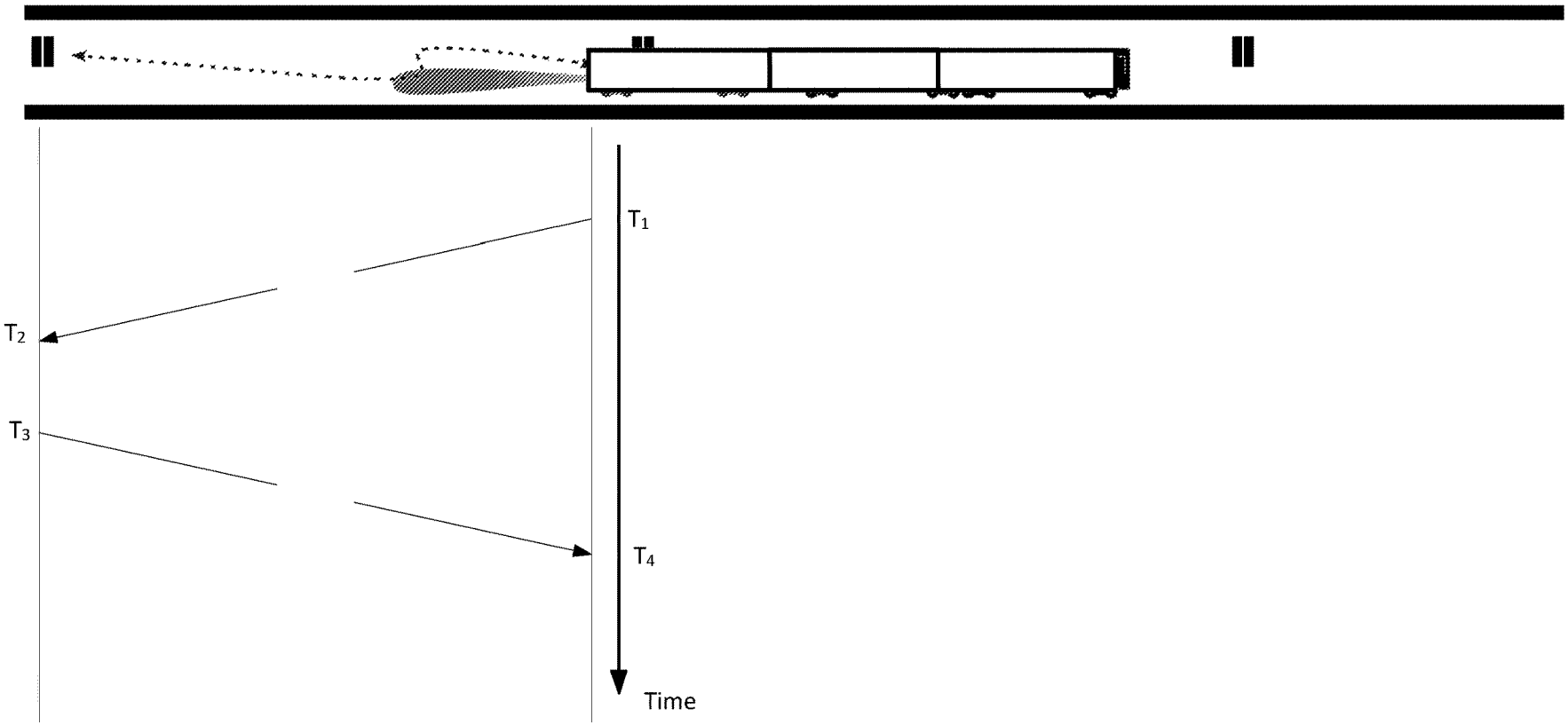
FIG. 4 is a schematic illustration of determination of a distance based on propagation time measurement.

The control system or apparatus 100, as schematically shown in FIG. 4, comprises a controller 101 arranged to determine present positions of rail-bound vehicles on at least one railway of the railway system, and to issue control signals to control the operation of said vehicles, and/or said internal or external system, based on said determined present positions.

The control system further comprises, or is connected to, a transmitter and receiver 102 for wireless communication with at least one base station arranged at a predetermined position in the vicinity of the railway, and a measurement device 103 to determine a distance to the at least one base station based on measurements of the radio signals of the wireless communication in the time domain and/or phase domain. The controller 101 is arranged to determine a present position of the vehicle on said railway based on said distance.

The fixed positions of the base stations may be stored in a database 104, which may be included in the control system, or be connected to the control system. The exact location of the base stations can be received from the operators, or could be identified by initialization measurements. The database may also comprise data at least about the identity of the base stations and the position of the base stations, and optionally also about the coverage area of the trackside base stations in relation to the vehicle path.

The transmitter and receiver 102 used for the wireless communication for determining the distance to the base stations may occur over a dedicated wireless communication system, e.g. a communication system provided for safe and reliable communication between the train and an external control center, such as the dedicated wireless communication system GSM-R. However, the wireless communication may additionally or alternatively occur over other types of wireless communication, such as by WLAN communication, such as in accordance with the IEEE 802.11 standard, or communication via one or several of presently available 3G, 4G and 5G standards may also be used with the same safety and reliability. The data packets used for determination of the distance may be transmitted for the sole purpose of positioning, or may be normal payload-carrying data packets within the communications link, upon which the aforementioned measurements are performed.

Figure 5:
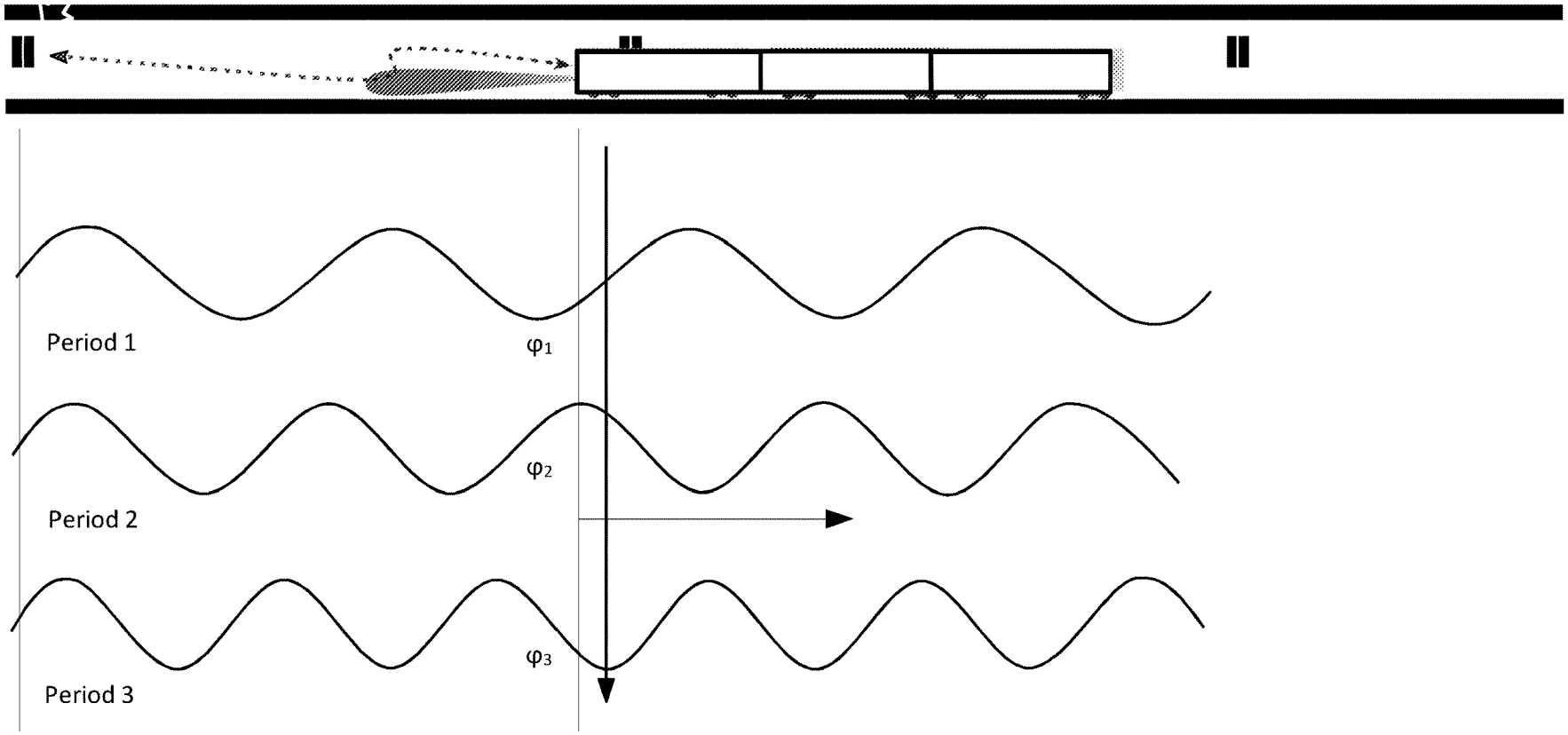
FIG. 5 is a schematic illustration of determination of a distance based on phase differences.

In accordance with one embodiment of the invention, as illustrated in FIG. 5, the radio signal measurements comprise measuring of a propagation time for radio signals transferred between the vehicles and the base stations. In particular, the propagation time may be measured by measuring the round-trip time for a data packet to be sent from a first party to the other party, and a response to be sent back from the second party to the first party, and subtracting the round-trip time with a processing time of the second party before sending the response.

Having determined the propagation time for signals travelling from the vehicle to the base station or from the base station to the vehicle, it is simple to determine the exact distance, since the radio signals travels with the speed of light. Thus, the distance may be calculated as the propagation time multiplied with the speed of light. By knowing the distance to the base station, and by knowing the fixed position of the base station, as well as the fixed path of the railway track, it is possible to determine with great exactness the position of the vehicle travelling on the railway track.

An example of such a measurement is schematically illustrated in FIG. 5. An initiating party, which is here the vehicle-based equipment, but may also be a wayside base station, records the time-of-departure $t_1$ of a data packet sent over the air. A responding party, here the base station, receives the data packet, recording the time-of-reception, $t_2$. The responding party, i.e. here the base station, then transmits a response data packet and records the time-of-departure, $t_3$. The initiating party, i.e. here the onboard equipment, notes the time-of-reception, $t_4$.

The control system, being the initiating party, then calculate the round-trip propagation time $t_p$ as follows:

$$t_p=(t_4-t_1)-(t_3-t_2)$$

i.e. by subtracting the responding party's processing time from the total round-trip time.

The distance d between the train and the base station is then calculated by multiplying the one-way propagation time, corresponding to the round-trip propagation time divided by two, with the speed of light c:

$$d=t_p/2*c$$

Figure 6:
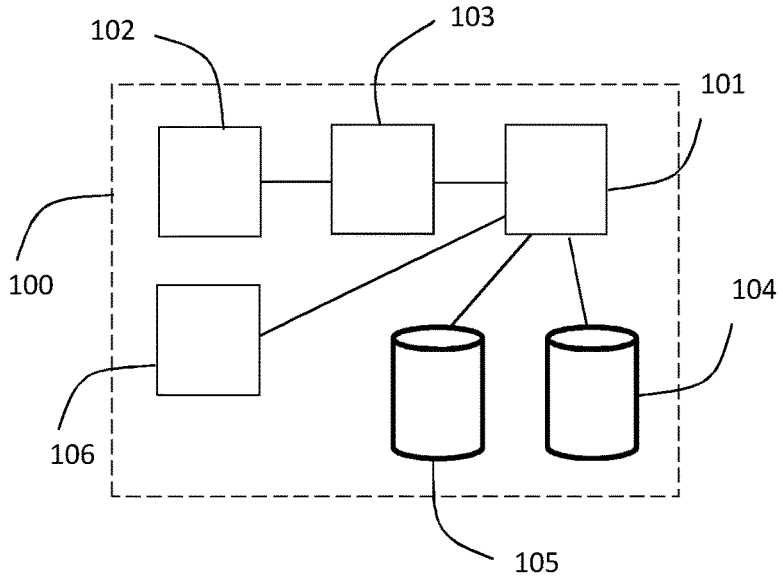
FIG. 6 is a schematic illustration of a control system/apparatus in accordance with an embodiment of the invention.

In accordance with another embodiment of the invention, the radio signal measurements comprise measuring of a phase difference of radio signals of different frequencies transferred between the vehicles and the base stations. This is schematically illustrated in FIG. 6. Here, the control system is arranged in the vehicle, but as already discussed, the control system may additionally or alternatively be arranged at the base station. The base station transmits signals to the train over a plurality of different frequencies, and consequently, the signals will be received at the vehicle at different phases $\varphi_1, \varphi_2, \varphi_3, \ldots$ The distance is then determined based on the difference in phase between signals received at the various possible frequencies of operation, utilizing the fact that the signal phase at the receiving station with respect to the phase at the transmitting station is dependent on: a) the carrier frequency, and b) the distance between the transmitting and the receiving station. Thus, the phase set for each position is unique within a range of plausible distances from the base stations, and by determining the phase of the received signal with respect to the transmitted signal at a plurality of carrier frequencies, the distance between the transmitting and receiving stations can be determined as it will represent the only mathematically possible solution to a system of equations describing the phases of signal received with respect to signals transmitted of each carrier frequency as functions of the distance between the transmitting and receiving stations.

In yet another embodiment, the distance between the vehicle and the base station is determined based on signal strength/power, since the signal strength/power will diminish as a function of the distance.

It is also possible to determine the distance based on any combination of two or more of the above-discussed methodologies.

In addition to determining the distance between the vehicle and base stations, and to determine the position of the vehicle based on the determined distances, the control system/apparatus may also be arranged to determine at least one of travelling speed and travelling direction for the rail-bound vehicles based on the radio signal measurements. This can e.g. be done by storing position data for the vehicle for one or several previously made determinations in a database 105, and to make calculations based on the differences. Similarly, the controller can hereby also determine acceleration and deceleration for the vehicles.

Figure 7:
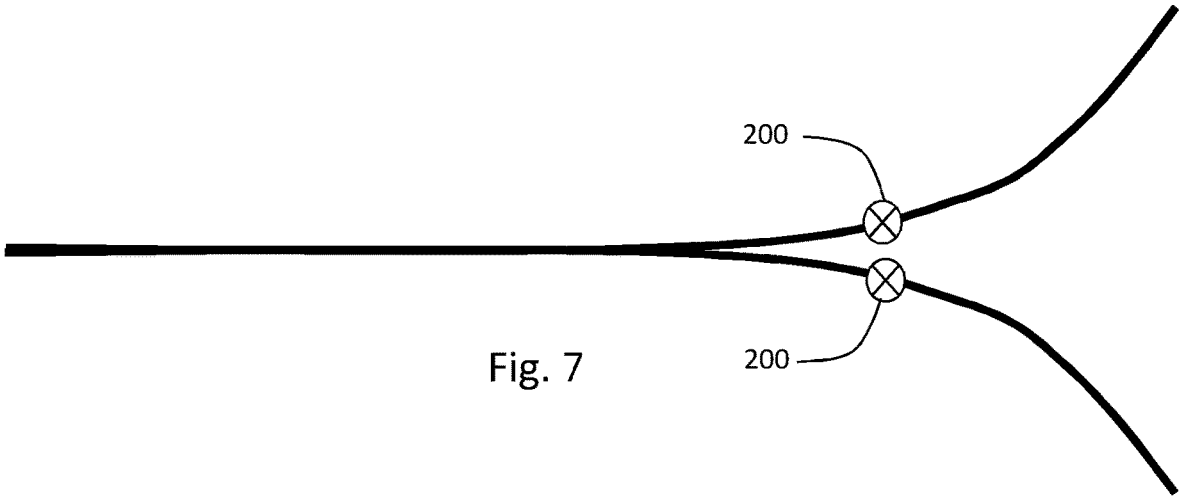
FIG. 7 is a schematic illustration of determination of track selection at branches.

In order to be able to determine which of the two or more tracks that has been chosen when passing through a junction with greater precision, the control system may further include a sensor 106 arranged to determine which track that is selected. The sensor 106 may e.g. be a signal sensor/receiver, receiving signals from transponders 200, balises or the like, arranged on one or both/several of the tracks branching out at the junction, as shown schematically in FIG. 7. However, other types of sensors may also be used. For example, the sensor may be a GNSS sensor, receiving GNSS signals, such as GPS signals, and thereby enabling determination of which track that has been selected. The sensor may also be an acceleration sensor, a gyro sensor or the like, being capable of determining in which direction and how fast the vehicle turns, a camera being able to determine the track based on image analysis, etc.

The control system may be integrated with, or be connected to, a control system automatically or semi-automatically controlling e.g. start, stop and speed of rail-bound vehicles travelling on a railway network, based on the issued control signals. For example, the control system of the present invention may be, or form a part of, a CBTC (Communication Based Train Control) system. Additionally or alternatively, the issued control signals related to the position of the vehicle may be used in internal or external systems related to such vehicles, e.g. for value-adding automated processing, such as to allow a technological system, either onboard the train, or remote, to automatically generate more complex information based on the position information, for the purpose of relieving persons of strenuous manual and mental processing.

The above-described embodiments of the invention can be implemented in any of numerous ways. For example, the embodiments may be implemented using hardware, software or a combination thereof. When implemented in software, the software code can be executed on any suitable processor or collection of processors, whether provided in a single computer or distributed among multiple computers.

Also, the various methods or processes outlined herein may be coded as software that is executable on one or more processors that employ any one of a variety of operating systems or platforms. Additionally, such software may be written using any of a number of suitable programming languages and/or conventional programming or scripting tools, and also may be compiled as executable machine language code.

Such and other obvious modifications must be considered to be within the scope of the invention, as it is defined by the appended claims. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting to the claim. The word "comprising" does not exclude the presence of other elements or steps than those listed in the claim. The word "a" or "an" preceding an element does not exclude the presence of a plurality of such elements.

The invention claimed is:

1. A control system for controlling rail-bound vehicles in a railway system, the control system comprising a controller arranged to determine present positions of rail-bound vehicles on at least one railway of the railway system, and to issue control signals to control the operation of said vehicles, wherein the present positions of said vehicles are determined based on radio signal measurements in phase domain of wireless communication occurring between each vehicle and base stations arranged at predetermined positions in the vicinity of said railways, wherein the radio signal measurements in the phase domain comprises measuring of a phase difference of radio signals of different frequencies transferred between the vehicles and the base stations.

2. The control system of claim 1, wherein the control system is a CBTC (Communication Based Train Control) system.

3. The control system of claim 1, wherein the wireless communication is at least one of made over a Wireless Local Area Network (WLAN) and/or made via a cellular network standard.

4. The control system of claim 3, wherein the wireless communication is made by at least one of: WLAN and GSM-R.

5. The control system of claim 1, wherein the base stations are trackside base stations distributed along the extension of the railway(s).

6. The control system of claim 5, wherein the trackside base stations are access points for communication in compliance with a WLAN standard.

7. The control system of claim 1, wherein the controller is further arranged to determine at least one of travelling speed and travelling direction for said rail-bound vehicles based on said radio signal measurements.

8. The control system of claim 1, said control system being adapted to control at least one of start, speed and stop of the rail-guided vehicles on said railway(s) based on said issued control signals.

9. The control system of claim 1, further comprising a sensor arranged to determine which track that is selected when the vehicle passes through a junction.

10. A method for controlling rail-bound vehicles in a railway system, the method comprising:

measuring a radio signal in the phase domain of wireless communication occurring between each vehicle and base stations arranged at predetermined positions in the vicinity of railways of said railway system;

determining present positions of the rail-bound vehicles on at least one railway of the railway system based on said measurements; and issuing control signals to control the operation of said vehicles based on said determined present positions;

wherein the radio signal measurements in the phase domain comprises measuring of a phase difference of radio signals of different frequencies transferred between the vehicles and the base station.

11. An apparatus for determining a position of a rail-bound vehicle on a railway, the apparatus comprising:

a transmitter and receiver for wireless communication with at least one base station arranged at a predetermined position in the vicinity of the railway;

a measurement device to determine a distance to said at least one base station based on measurements of radio signals of said wireless communication in the phase domain; and a controller arranged to determine a present position of said vehicle on said railway based on said distance;

wherein the radio signal measurements in the phase domain comprises measuring of a phase difference of radio signals of different frequencies transferred between the vehicles and the base stations.

12. The apparatus of claim 11, wherein the apparatus is comprised within a mobile router arranged within the rail-bound vehicle.

13. A method for determining a position of a rail-bound vehicle on a railway, the method comprising:

providing wireless communication with at least one base station arranged at a predetermined position in the vicinity of the railway;

measuring a distance to said at least one base station based on measurements of radio signals of said wireless communication in the phase domain; and determining a present position of said vehicle on said railway based on said distance, wherein the radio signal measurements in the phase domain comprises measuring of a phase difference of radio signals of different frequencies transferred between the vehicles and the base stations.

* * * * *